US006048138A

United States Patent [19]

Lamberson et al.

[11] Patent Number: 6,048,138

[45] Date of Patent: Apr. 11, 2000

[54] CONCEALED CRASH WALL IN COMBINATION WITH MECHANICALLY STABILIZED EARTH CONSTRUCTION

[75] Inventors: Eugene A. Lamberson, Monticello, Ill.; Sherif A. Aziz, Fairfax Station; Roger A. Bloomfield, Great Falls, both of Va.

[73] Assignee: The Reinforced Earth Company, Vienna, Va.

[21] Appl. No.: 09/166,053

[22] Filed: Oct. 5, 1998

[51] Int. Cl.[7] ..... E02D 5/20; E02D 29/02

[52] U.S. Cl. ..... 405/262; 405/284; 405/286

[58] Field of Search ..... 405/262, 284, 405/285, 286, 258, 272, 273

[56] References Cited

U.S. PATENT DOCUMENTS

| | | | |
|---|---|---|---|
| 1,900,205 | 3/1933 | Sherrill | 405/287 |
| 4,055,927 | 11/1977 | Tamaro | 405/287 |
| 4,329,089 | 5/1982 | Hilfiker et al. | 405/287 X |
| 4,391,557 | 7/1983 | Hilfiker et al. | 405/287 |
| 4,643,618 | 2/1987 | Hilfiker et al. | 405/287 |
| 4,961,673 | 10/1990 | Pagano et al. | 405/287 X |
| 5,002,436 | 3/1991 | Sigourney | 405/262 |
| 5,356,242 | 10/1994 | Elmore et al. | 405/287 X |

FOREIGN PATENT DOCUMENTS

| | | | |
|---|---|---|---|
| 2131063 | 6/1984 | United Kingdom | 405/287 |

OTHER PUBLICATIONS

Hilfiker Literature, date unknown but prior to 1993. "VSL Retained Earth Metal Facing Wall System Installation Manual" brochure. On information and belief, this document was submitted to the Florida Department of Transportation in 1991 or early 1992.

*Primary Examiner*—Dennis L. Taylor
*Attorney, Agent, or Firm*—Banner & Witcoff, Ltd.

[57] ABSTRACT

A retaining wall construction includes a lower mechanically stabilized earth bulk form with tensile members projecting from the front face of the bulk forms and connected to precast wall panels that are spaced from the front face of the bulk form. The space between the front face of the bulk form and the panels is filled with concrete. Positioned on top of the reinforced concrete and the first bulk form, as well as along the sides thereof, are additional bulk forms which include tensile members connected directly to the front facing panels.

10 Claims, 3 Drawing Sheets

CONCEALED CRASH WALL IN COMBINATION WITH MECHANICALLY STABILIZED EARTH CONSTRUCTION

BACKGROUND OF THE INVENTION

This invention relates to an improved retaining wall construction and, more particularly, to a retaining wall construction of the type generally depicted in U.S. Pat. No. 4,961,673 comprising a bulk form with reinforcing or stabilizing elements located therein, a front face of precast wall panels in opposed and spaced relation to the bulk form and a reinforced cementations material in the space between the front wall panels and the bulk form.

In U.S. Pat. No. 4,961,673, entitled "Retaining Wall Construction and Method for Construction of Such a Retaining Wall," there is disclosed a construction which includes a bulk form separated from facing panels with reinforced concrete or cement filing the space between the wall panels and the bulk form. The bulk form utilizes a grid or facing material which defines the front face of the bulk form. U.S. Pat. No. 4,961,673 is incorporated herewith by reference.

The construction of U.S. Pat. No. 4,961,673 is useful and provides a means for incorporating a solid concrete support wall, intermediate wall facing panels and an earthen work bulk form. Utilization of such a construction for the purpose of providing retaining walls has required pouring of a concrete wall intermediate the height of wall facing panels and the bulk form in layers. Such a construction has been useful and utilitarian, however, improvements in such a construction have been sought, including improvements wherein the continued pouring or addition of a cement intermediate wall may be eliminated or altered in terms of the steps for the erection of the entire retaining wall construction.

SUMMARY OF THE INVENTION

Briefly, the present invention comprises an improved retaining wall construction formed of multiple, but combined, earthen work bulk forms wherein a lower bulk form includes a reinforced concrete or cementatious portion intermediate the bulk form and front facing panels for the bulk form. Positioned on the first bulk form is a second bulk form which utilizes a continuation of the front facing panels as the outer face of the bulk form. A variant or version of the retaining wall includes vertical support piles which are retained in and passed through both of the bulk forms forming the retaining wall. Thus a lower or first earthen work bulk form includes generally aligned or parallel tensile members projecting through a grid defining the front face of the bulk form. The tensile members are connected to precast wall panels arrayed to form a facing. Reinforced cementatious material, e.g., concrete, fills the space between the first bulk form, and more particularly between the grid defining the front face of the first bulk form, and the backside of the precast wall panel array. The cementatious or concrete portion of the retaining wall thus defines an additional protective barrier for the bulk form. Thus the front panels of the retaining wall are backed by a concrete wall which, in turn, is backed by a mechanically stabilized earthen work bulk form.

Positioned on top of the first bulk form is a second bulk form which overlies not only the first bulk form but also the cementations or concrete wall. The second bulk form thus includes elongated tensile members which engage directly with precast front facing panels. A bulk form facing grid is thus eliminated or unnecessary. Vertical piles extend downwardly through both of the bulk forms and are positioned so as to be separated from the concrete barrier between the first bulk form and the precast front facing panels. The vertical piles may support a plate or platen which, in turn, may support a bridge deck or the like.

During construction, the first bulk form is constructed. The front facing panels are also erected and spaced from the first bulk form. The space between the first bulk form and the front facing panels then receives cement or concrete up to a desired layer or level above a datum plane. Vertical piles may be driven into the soil under the first bulk form prior to the formation of the bulk form or they may be positioned or driven through the bulk form during any stage of the construction. A second bulk form is then added over the first bulk form and the reinforced barrier wall. The second bulk form is constructed in a manner such as disclosed in Vidal U.S. Pat. No. 3,421,326; U.S. Pat. No. 3,686,873; U.S. Pat. No. 4,045,965 and U.S. Pat. No. 4,116,010.

Thus, it is an object of the invention to provide an improved retaining wall construction which includes a reinforced, cast-in-place barrier wall in combination with a bulk form and facing elements which are precast and assembled at a site.

Yet a further object of the invention is to provide retaining wall construction which is comprised of at least two bulk forms integrated together with one bulk form positioned on top of the other and forming a continuum of a lower or first bulk form but wherein the upper or second bulk form is connected directly to precast facing panels and the lower or first bulk form is connected to a grid spaced from facing panels.

Yet another object of the invention is to provide an inexpensive and easily erectable, improved retaining wall construction which includes a reinforced wall section adjacent the lower portion of the retaining wall which comprises a crash barrier and energy absorbing wall.

Yet a further object of the invention is to provide a retaining wall construction and a method for erection thereof which is easily accomplished and does not require special equipment or component parts.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
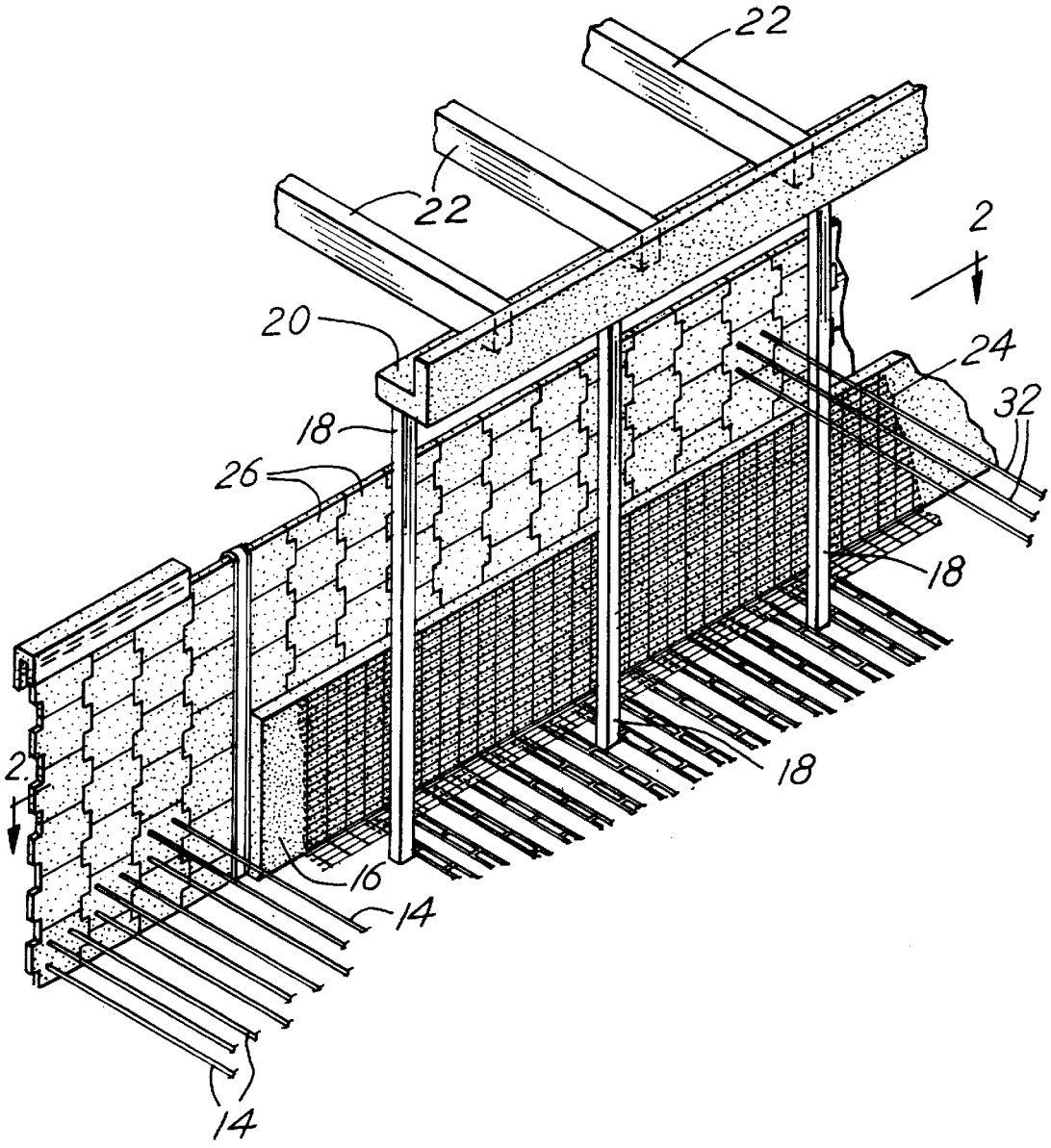
FIG. 1 is a perspective view of the retaining wall of the invention.

U.S. Pat. No. 4,961,673 discloses a construction for a retaining wall which has similar characteristics, in part, to the construction of the present invention. However, the present invention comprises an improvement and is thus distinct with regard to various features from the referenced patent. It is further noted that the subject matter of the present invention is especially useful in circumstances where the retaining wall to be constructed requires a crash or energy absorbing barrier positioned along its lower side or region. That is, the subject matter of the invention is particularly useful to provide a hidden, reinforced barrier which will protect the bulk form and enhance the integrity of the bulk form against engagement from an external force. For example, if the retaining wall of the present invention is utilized for a bridge abutment on opposite sides of a railroad track, the integrity of the bridge abutments will be enhanced by providing reinforced concrete in the abutments which will protect against adverse external contact against the wall panels and the reinforced elements incorporated in the wall panels. In this manner, the abutment not only has structural integrity for support of a bridge span, for example, but also has enhanced integrity with respect to engagement of the bridge abutment by a railroad car, truck or some other item which may be driven into it or engage the abutment. Finally, the width of the bridge span may be maintained at a minimum since the crash barrier is merged into the abutment.

Therefore, referring specifically to the figures, the improved retaining wall construction of the invention is comprised of a first earthen work bulk form 10 which has a three dimensional configuration of length, width and height and extends upwardly from a datum plane 12. The bulk form 10 is formed in a conventional manner as taught in the prior referenced patents by alternately providing layers of compactable fill 11 and tensile members 14. The tensile members 14 may be the type taught in U.S. Pat. No. 4,710,062 or any other tensile member which provides for interaction with the compactable fill forming the bulk form 10 and engagement therewith, at least partially by friction. The height of the first bulk form 10 is substantially equal to that of a cast-in-place wall 16 to be described in greater detail hereinafter. Prior to forming the first bulk form 10, vertical piles 18 may be driven into the soil. The vertical piles 18 may support a bridge seat or plate 20 which ultimately supports bridge girders 22, for example.

The tensile members 14 connect with a facing grid 24 which forms a front face of the bulk form 10. The grids 24 may be any of a multiple number of types of grids. Typically the grids 24 are a wire mesh. The referenced prior art patents teach various types of grids, all of which may be utilized in the construction of the present invention. Spaced from the grids 24 are precast panels 26 which are arranged one course upon the other. The reinforcing tensile members 14 thus engage with and connect not only to the grid 24 but also to the backside of the panels 26 to thereby provide for appropriate spacing between a front wall formed by panels 26 and a bulk form front face defined by the grid 24. The space between the grid 24 and the panels 26 receives a cast-in-place concrete wall which is reinforced by the tensile members 14. Additional reinforcing rods or elements may, however, be inserted in the region between grid 24 and the backside of panels 26 to further reinforce the cast-in-place wall 16.

Positioned on top of the first bulk form 10 is a second bulk form 30. The second bulk form 30 includes tensile members 32 similar to the tensile members 14. The tensile members 32 connect directly to the backside of panels 26 at connectors 34, for example. The second bulk form 30 thus overlies not only the first bulk form 10 but also the cast-in-place wall or reinforced concrete wall 16. Additionally the grid 24 is omitted from the second bulk form 30 although a grid may be incorporated for additional mechanical stabilization of the bulk form 30, particularly during construction thereof. A grid, however, is not required for the bulk form 30.

It is to be noted that the piles 18 extend through both of the bulk forms 10 and 30 and project above the second bulk form 30 to support the bridge seat 20. The piles 18 may be sleeved to permit settling of the compacted soil or fill 11 without adversely affecting the piles 18.

The first bulk form may be built in layers of fill 11 as disclosed in the prior art references. Similarly, the second bulk form 30 may be constructed in layers. The layers are, of course, compacted so as to provide for frictional engagement between the tensile members 14, 32 and the fill 11 which is utilized to form the bulk forms 10, 30.

It is noted that by maintaining the piles 18 in the bulk forms 10, 30, it is possible to provide that the cast-in-place wall 16 will protect the piles 18 from distortion, even though the cast-in-place wall 16 may be distorted by engagement from some external source.

Figure 2:
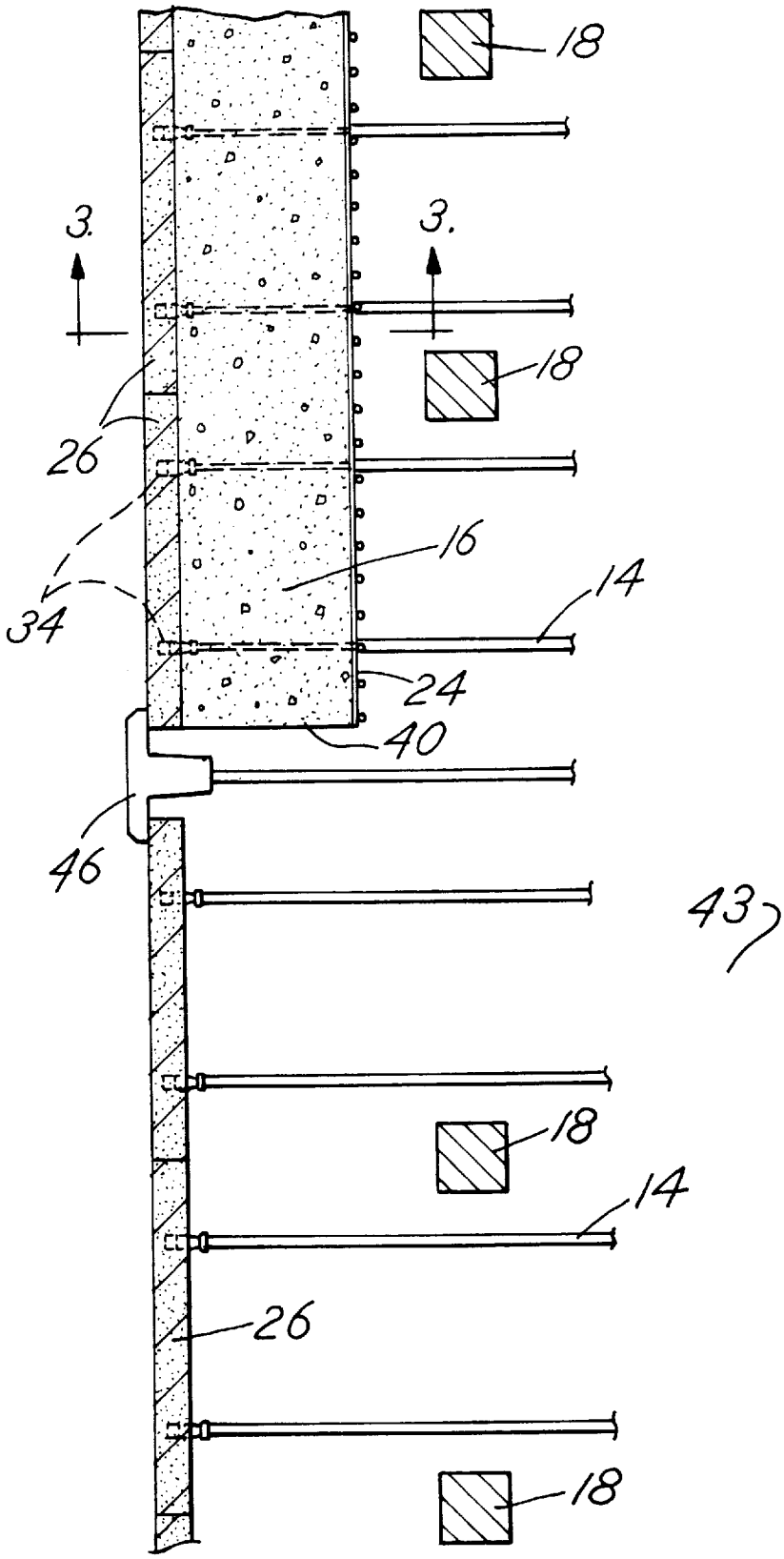
FIG. 2 is a plan view of the retaining wall of FIG. 1 along the line 2—2 in FIG. 1.
Figure 3:
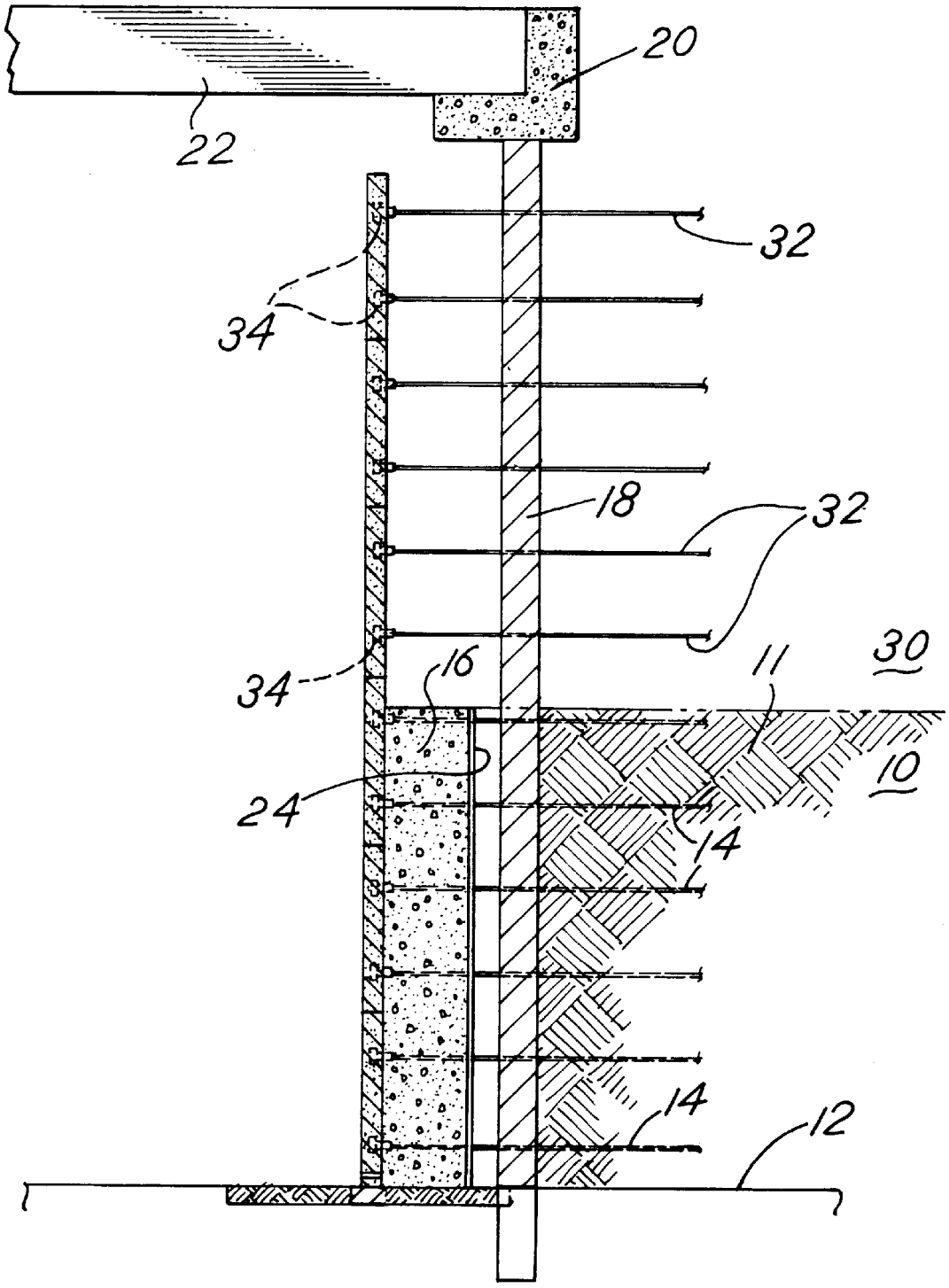
FIG. 3 is a vertical cross-sectional view of the retaining wall of FIG. 2 taken along the line 3—3.

As shown in FIG. 2, the cast-in-place wall 16 may also have a vertical side 40 which is defined by a grid or a form, for example (not shown). Thus, the abutment or wall may have wings or sides defined by a third bulk form 43 which has facing panels 26 and also includes tensile members 14 directly connected thereto. The third bulk form 43 may be connected to the first bulk form 10 and the second bulk form 30 along a junction defined between the first and third bulk forms 10, 30 by means of a slip-joint connector 46. In this manner, the third bulk form 43 may settle differentially from the first and second bulk forms 10 and 30 without distortion to the assemblage of bulk forms. Nonetheless, the bulk forms 10, 30, 43 interact and connect one to the other and are all defined by tensile members compacted with fill 11. The slip joint member 46, however, enables the total assembly to accommodate any settling which may occur without causing unnecessary stresses or distortions to the cast-in-place wall 16.

The type of tensile members which may be utilized is highly variable. The form of grid 24 is also variable. The grid 24 may extend vertically or there may be a horizontal component thereto. The connection between the tensile members 14 and the front panels 26, as well as the grid 24, may be varied. If desired, the piles 18 may be incorporated within and supported by the reinforced wall 16, though the preferred embodiment is depicted. The cast-in-place wall 16 may have variable thicknesses during the construction process. That is, a first bulk form may have a wide space between the grid 24 and the panels 26. A second layer may have a more narrow dimension and so on so that the configuration of the cast-in-place wall 16 may be varied vertically using variable spacing between the grid 24 and the front panels 26. Typically the wall 16 is about 2.5 feet in thickness and may or may not be reinforced. The wall 16 acts as an energy absorbing barrier and/or crash barrier on the inside of facing panels 26. Thus the wall 16 may be constructed to enhance energy absorbing characteristics. The invention, therefore, is to be limited only by the following claims and equivalents thereof.

What is claimed is:

1. A retaining wall construction comprising, in combination:

(a) a granular, compactible fill material defining a first three-dimensional earthen work bulk form having a top and a generally planar front face extending upwardly from a datum plane;

(b) a plurality of elongated tensile members dispersed in generally aligned orientation in the first bulk form, at least some of said tensile members extending from the front face outwardly from the bulk form;

(c) a grid along the front face of the first bulk form, said grid being attached to selected tensile members;

(d) a plurality of preformed panel facing elements in generally vertical array defining a facing wall spaced from the front face of the first bulk form; said panels connected to tensile members extending from the first bulk form front face;

(e) a reinforcing wall of cementatious material in the space intermediate the facing wall and first bulk form front face, said reinforcing wall encapsulating the tensile members in said space, said reinforcing wall extending upwardly from the datum plate to the top of the first bulk form; and (f) a further, second bulk form of compatible fill material overlying the first bulk form and the reinforcing wall, said second bulk form including a plurality of tensile members and a planar front face, said panel facing elements extending upwardly from the top of the first bulk form, said second bulk form front face opposed against said upwardly extending panel facing elements, at least some of said tensile members in said second bulk form attached to upwardly extending panel elements.

2. The construction of claim 1 wherein the reinforcing wall includes supplemental reinforcing elements.

3. The construction of claim 1 wherein the elongated tensile members comprise elongated metal strips.

4. The construction of claim 1 further including generally vertical support piles extending into the first and second bulk forms.

5. The construction of claim 1 further including generally vertical support piles through the first and second bulk forms.

6. The construction of claim 4 or 5 further including a support plate supported by support piles.

7. The construction of claim 1 including an additional bulk form laterally adjacent the first and second bulk forms.

8. The construction of claim 7 wherein the additional bulk form has facing panels separated from the facing panels of the other bulk forms.

9. A retaining wall construction comprising, in combination:

(a) a granular, compactible fill material defining a first three-dimensional earthen work bulk form having a top and a generally planar front face extending upwardly from a datum plane;

(b) a plurality of elongated tensile members dispersed in generally aligned orientation in the first bulk form, at least some of said tensile members extending from the front face outwardly from the first bulk form;

(c) a grid along the front face of the first bulk form, said grid being attached to selected tensile members;

(d) a plurality of preformed panel facing elements in generally vertical array defining a facing wall spaced from the front face of the first bulk form; said panels connected to tensile members extending from the first bulk form front face;

(e) a reinforcing wall of cementatious material in the space intermediate the facing wall and first bulk form front face, said reinforcing wall encapsulating the tensile members in said space, said reinforcing wall extending upwardly from the datum plate to the top of the first bulk form;

(f) a further, second bulk form of compactible fill material overlying the first bulk form and the reinforcing wall, said second bulk form including a plurality of tensile members and a planar front face, said panel facing elements extending upwardly from the top of the first bulk form, said second bulk form front face opposed against said upwardly extending panel facing elements, at least some of said tensile members in said second bulk form attached to panel upwardly extending panel elements; and (g) a plurality of generally vertical support piles through the first and second bulk forms.

10. The retaining wall of claim 1 or 9 wherein the grid extends to the top of the first bulk form.

* * * * *